United States Patent [19]

Kiss

[11] 3,951,270

[45] Apr. 20, 1976

[54] TIE RACK FOR PREKNOTTED TIES

[76] Inventor: Stephen Kiss, 6050 S. 27th St., Apt. 18, Milwaukee, Wis. 53221

[22] Filed: Nov. 18, 1974

[21] Appl. No.: 524,604

[52] U.S. Cl. ..... 211/119; 211/181; 220/19

[51] Int. Cl.[2] ..... A47F 5/08

[58] Field of Search ..... 211/13, 60 R, 181, 113, 211/119, 11, 49, 50, 40, 41, 61, 181; 248/302, 303; D6/251, 113, 117, 118; 220/19; 211/115, 116

[56] References Cited

UNITED STATES PATENTS

| | | | |
|---|---|---|---|
| 2,620,074 | 12/1952 | Moore, Jr. | 211/119 |
| 2,889,054 | 6/1959 | Wheeler | 211/181 X |
| 2,905,331 | 9/1959 | Ross | 211/13 X |
| 3,176,849 | 4/1965 | Peebles | 211/181 X |
| 3,245,736 | 4/1966 | Douthit | 211/40 X |
| 3,270,889 | 9/1966 | Pochopien | 211/13 |
| 3,342,345 | 9/1967 | Van Dusen | 211/119 |
| D179,907 | 3/1957 | Kruger | 211/119 X |

*Primary Examiner*—Roy D. Frazier
*Assistant Examiner*—Terrell P. Lewis
*Attorney, Agent, or Firm*—Arthur L. Morsell, Jr.

[57] ABSTRACT

A plurality of flat rectangular wire frames are attached in spaced-apart relationship to a horizontal support rod and depend downwardly therefrom. Alternate pairs of frames are so spaced apart as to form vertical tie-receiving slots for preknotted ties. Lower tie-supporting rods are attached to and extend between the bottom corners of the frames to connect lower portions of the frames and provide stops for the lowermost tie in each tie-receiving slot.

7 Claims, 3 Drawing Figures

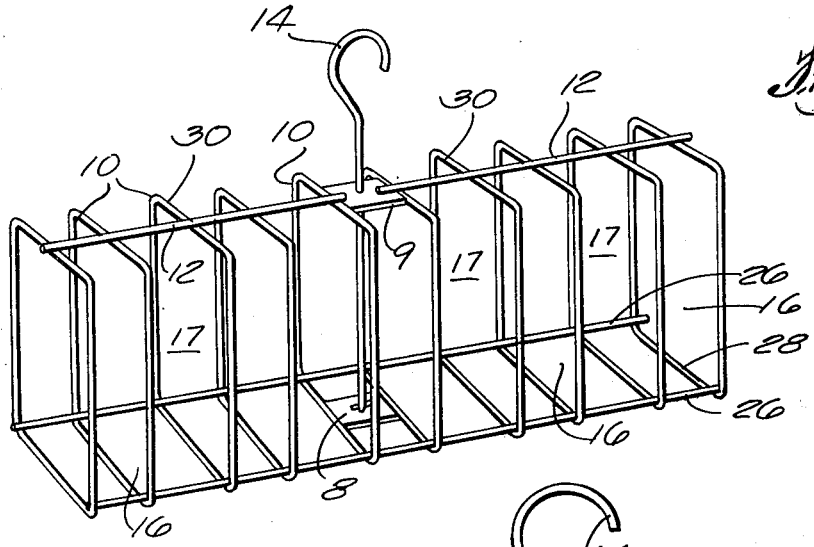
Fig. 1
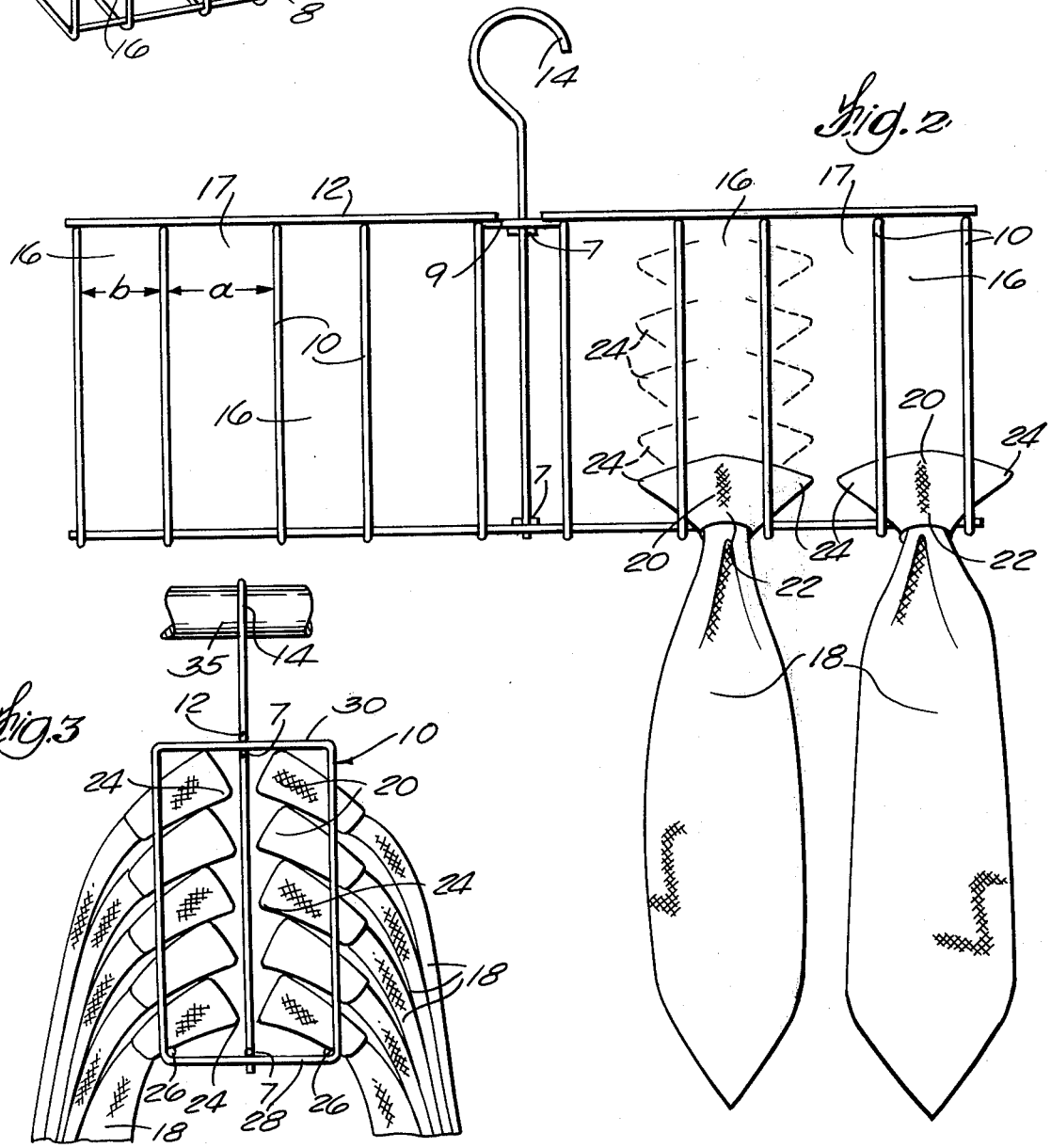
Fig. 2
Fig. 3

TIE RACK FOR PREKNOTTED TIES

BACKGROUND OF THE INVENTION

This invention relates to tie racks for preknotted ties. Such racks have been made in the past as disclosed in U.S. Pat. No. 3,342,345 to Van Dusen. However, the Van Dusen tie rack has a small tie-holding capacity and a need exists for a preknotted tie rack that can hold a substantially large number of ties and can be conveniently suspended within a clothes closet.

SUMMARY OF THE INVENTION

The tie rack of this invention includes a plurality of flat wire frames which are supported in spaced-apart relationship in a horizontal row and which are so spaced apart as to form vertical tie-receiving slots on both sides of the assemblage. Means is provided for supporting the lowermost tie in each tie-receiving slot. The double row of tie-receiving slots holds a large number of ties in a compact space and can be conveniently suspended within a clothes closet.

A general object of the invention is to provide a rack for preknotted ties which is simple and inexpensive to manufacture, which is convenient to use, which is compact, and which makes it possible to suspend a relatively large number of ties from a single hook, with all of the ties readily accessible for selection.

DESCRIPTION OF THE DRAWINGS

FIG. 1 is a perspective view of the preferred embodiment of the invention.

FIG. 2 is a side elevational view showing preknotted ties in the tie-receiving slots thereof.

FIG. 3 is an end elevational view showing preknotted ties in the tie-receiving slots.

DESCRIPTION OF THE PREFERRED EMBODIMENT

Referring to FIGS. 1–3, the preferred embodiment of the invention comprises a plurality of flat rectangular frames 10 which are attached in spaced-apart relationship to horizontal support rods 12 and depend downwardly therefrom to form a horizontal row. The inner ends of the rods 12 are connected to a bearing plate 9. The frames may be formed of metal wire of the type used in clothes hangers. There is a lower bearing plate 8 directly below the plate 9. A hook 14 has a shaft rotatable in the bearing plates for swivelling movement, there being stops 7 on the shaft. The hook extends upwardly therefrom for suspending the rack from a closet pole or the like. Pairs of rectangular frames 10 are so spaced as to form vertical tie-receiving slots 16 (FIG. 2) for receiving preknotted ties 18 having inverted triangular knot portions 20 with relatively narrow apexes 22 and with projecting corners 24, sometimes in the form of plastic tabs, projecting laterally from the upper corners thereof. Knot portions 20 are held within slots 16 by the side portions of frames 10. Rods 26, which are attached to opposite corners of frames 10 and extend the length of the assembly, form stops for the lowermost tie in a slot 16.

Each pair of frames 10 which forms a tie-receiving slot 16 are spaced, as at 17, from the next pair by a distance *a* which is greater than distance *b.* The distance *b* is greater than the width of apex portions 22 of knots 18 but is smaller than the distance between projecting corners or tabs 24. The distance *a* is preferably great enough to accommodate the projecting corners or tabs 24 from adjacent slots 16 without overlap, but less spacing could be used if desired, since the corners or tabs 24 could be overlapped if necessary to conserve space. Each alternate pair of frames 10 forms a tie-receiving slot 16 on each side, both of which can receive a stack of ties 18 as shown in FIG. 3. To conserve space, the width of each frame as shown in FIG. 3 may be just sufficient to accommodate the two stacks of inwardly-angled knots, one angling in from one side and one from the other.

The embodiment shown in FIGS. 1–3 has ten tie-receiving slots 16, five on each side, which can each hold five ties for a total tie-holding capacity of fifty ties. It will be obvious that the tie-holding capacity of this invention can be increased if desired by adding more slots 16 or by making frames 10 longer. The tie-holding capacity can also be decreased if desired by reducing the number of slots 16 or by making frames 10 shorter. However, the tie rack illustrated is very desirable as it will conveniently fit within a clothes closet alongside conventional clothes hangers while rendering all of the ties readily accessible for selection. In this case, the hook may be engaged with a closet pole 35, as in FIG. 3. The rack may also be hung from hooks on doors or in closets, or from drawer handles.

The frames 10, rods 12 and 26, and hanger 14 are preferably made of suitable metal which can be chrome plated or painted to reduce corrosion and can be joined together by welding, brazing or soldering. However, other materials such as wood or plastic can be used if desired. It should be noted that the bottom wires 28 of frames 10 may be omitted if desired, but the use of such bottom wires renders the construction more rigid. Also, the upper corners of frame 10 may be on a radius, if desired, instead of being squared. Other modifications may be made in the disclosed embodiment without departing from the spirit of this invention, which includes all modifications falling within the scope of the following claims.

What I claim is:

1. In combination, a tie rack, preknotted ties having inverted triangular knot portions and having tabs projecting laterally from opposite upper corners thereof, said tie rack comprising a plurality of flat frames each having oppositely-disposed upright side portions, means supporting said frames in spaced-apart relationship in horizontal row formation, pairs of adjacent frames being so spaced apart that the distance between upright side portions is greater than the apex dimension of said triangular knot portion of a tie but is less than the distance between opposite ends of said tabs, thereby providing a row of upright tie-receiving slots on each side of the rack, said pre-knotted ties being supported in at least some of said slots of the rack, stop means at the bottom of each tie-receiving slot, and means for suspending said row of frames from a supporting structure.

2. The tie rack of claim 1 wherein said frames are generally rectangular in shape, and in which the means for supporting said frames in row formation includes horizontal support rod means extending the length of the row and connected to the upper portion of each frame intermediate the width thereof.

3. The tie rack of claim 1 wherein each frame has oppositely-disposed lower corner portions, and wherein said stop means comprises a pair of horizontally-extending rods connecting said lower corner portions of said frames.

4. The tie rack of claim 2 wherein said means for suspending said row of frames comprises a hook connected to said horizontal support rod means intermediate the length of the rack and projecting upwardly therefrom.

5. The tie rack of claim 1 wherein the pairs of frames which form said tie-receiving slots are spaced from each other by a distance which is great enough to accommodate the projecting tabs of ties in tie-receiving slots on both sides.

6. The tie rack of claim 5 in which the width of said spaces for said projecting tabs is greater than the width of the tie-receiving slots.

7. The tie rack of claim 1 in which the width of each frame is sufficient to accommodate the knot portions which project inwardly from the slots on one side of the rack as well as the knot portions which project inwardly from the slots on the other side of the rack.

* * * * *